United States Patent [19]

Taktakian

[11] Patent Number: 5,022,288

[45] Date of Patent: Jun. 11, 1991

[54] CRIMPED CAP REMOVAL AND RETURN ASSIST DEVICE

[75] Inventor: Harry Taktakian, 1030 Medford Rd., Pasadena, Calif. 91107

[73] Assignee: Harry Taktakian, Pasadena, Calif.

[21] Appl. No.: 595,273

[22] Filed: Oct. 9, 1990

[51] Int. Cl.[5] ..... B67B 7/18

[52] U.S. Cl. ..... 81/3.4; D8/40

[58] Field of Search ..... 81/3.07, 3.4; D8/33, D8/40

[56] References Cited

U.S. PATENT DOCUMENTS

| | | | |
|---|---|---|---|
| D. 261,854 | 11/1981 | Nielsen | D8/40 |
| D. 277,160 | 1/1985 | Antone | 81/3.4 |
| D. 280,594 | 9/1985 | Dow | D8/40 |
| D. 281,051 | 10/1985 | Nielsen | D8/40 |
| 1,924,579 | 8/1933 | Waterhouse | 81/3.4 |
| 1,952,660 | 3/1934 | Dryden | 81/3.4 |
| 1,960,531 | 5/1934 | Driscoll | 81/3.4 |
| 2,631,482 | 3/1953 | Rinehart | 81/3.4 |
| 3,812,741 | 5/1974 | Heine | 7/151 |
| 4,067,279 | 1/1978 | Lester et al. | 81/3.4 |
| 4,433,597 | 2/1984 | Rowland | 81/3.4 |
| 4,702,129 | 10/1987 | Allen | 81/3.4 |

*Primary Examiner*—Roscoe V. Parker

*Attorney, Agent, or Firm*—Louis J. Bachand

[57] ABSTRACT

A crimped cap removal and return assist device comprising a body with a pocket for engaging a crimped cap, a protruding midrib, and a boss for application of hand pressure while turning the body by the midrib in crimped cap engagement.

12 Claims, 1 Drawing Sheet

CRIMPED CAP REMOVAL AND RETURN ASSIST DEVICE

REFERENCE TO DISCLOSURE DOCUMENT

Figure 1:
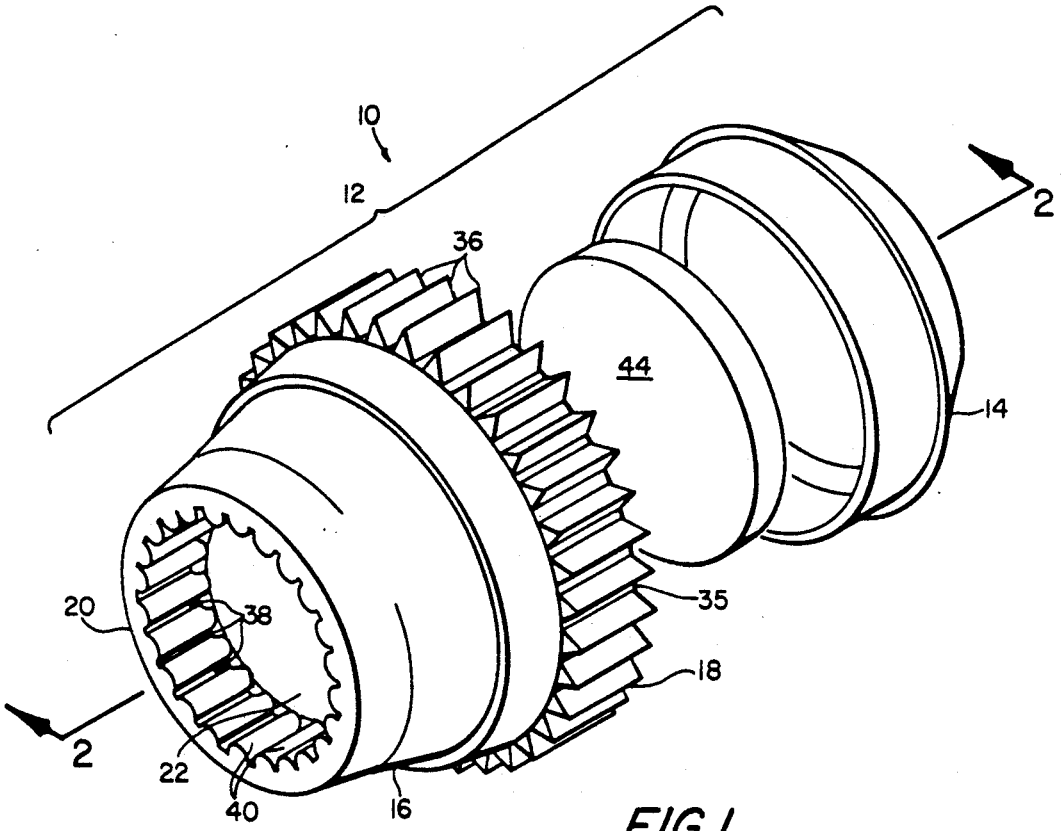

The herein described invention is the subject of Invention Disclosure Document No. 241 169 dated Dec. 8, 1989.

FIELD OF THE INVENTION

This invention has to do with devices for the removal of bottle caps and like crimped closures which are normally removable by hand or with cap removers such as leveraged cap removers. More particularly, the invention is concerned with novel means for engaging crimped caps for removal or return, providing full engagement of the cap ridges and lands, comfortable, mechanically advantaged gripping surfaces, and a boss for applying added engaging pressure as needed to facilitate removal or return of the crimped cap.

BACKGROUND OF THE INVENTION

Great numbers of beverages and other liquids are packaged in glass, plastic, or aluminum containers having narrowed necks which are closed with crimped-on cap closures. Traditionally, such caps have been removed with lever devices which opened the container but also destroyed the cap. Other opening assist devices have included open rings e.g. with directional grooves as in Rinehart U.S. Pat. No. 2,631,482 or other rib expedients as in Waterhouse U.S. Pat. No. 1,924,579 Brooks et al U.S. Pat. No. 4,414,865 U.S. Pat. Nos. Des. 261,854 and 281,051 both to Nielsen, U.S. Pat. No. Des. 277,160 to Antone, and U.S. Pat. No. Des. 280,594 to Dow. A device with a closed ring configuration is shown in U.S. Pat. No. 3,812,741 to Heine, and U.S. Pat. No. 1,952,660 to Dryden. Dryden's device is an oversize cup which can be pressed into shape over the cap to be removed, Heine's remover is rigid and uses the end wall to assist in cap removal.

The common failing of these and like prior art devices is the lack of added mechanical advantage and an absence of structure complimentary to the hand to facilitate use and easy removal of caps.

SUMMARY OF THE INVENTION

It is an object therefore of the present invention to provide a cap closure removal assistance device which affords increased mechanical advantage and which has structure complimentary to the hand for removal facilitation purposes. It is another object to provide a device in the use of which cap contours are preserved to ensure proper refittment and bottle resealing. It is another object to provide such a device with an embedded magnet for magnetic attachment to metal objects.

These and other objects to become apparent hereinafter are realized in accordance with the invention by provision of a crimped cap removal and return assist device comprising a body having oppositely tapered upper and lower conical portions and a protruding circular midrib therebetween, the lower conical portion being truncated and defining an outwardly open cylindrical pocket adapted to non-slippingly grip the ridges of a crimped-on bottle cap for rotation on or off a bottle, the upper conical portion being truncated to defining a transverse boss, the midrib being of greater diameter than the lower conical portion pocket and adapted to be gripped by a user's hand for rotating the body in the cap-engaged condition of the pocket, the upper conical portion boss being adapted and arranged to support the user's hand between the thumb and index finger thereof for application of increased hand pressure to the body while rotating the same for removal or return of the cap.

In this and like embodiments, additional features include having the midrib peripherally knurled for enhanced grippability, having the body is formed of rigid plastic, and having the pocket interiorly ribbed for positive engagement with a bottle cap, having a magnet within the body for supporting the body against a surface.

In particularly preferred embodiments, the midrib has a diameter not less than about 150% of the diameter of the pocket, is located approximately ⅔ of the way along the body vertical axis, whereby the upper conical portion is less vertically extended than the lower vertical extension, and is vertically extended a distance approximately equal to the vertical extension of the pocket. As in previous embodiments, in this embodiment the body is an integral molding of a rigid plastic, the midrib is peripherally knurled as with spur teeth, the pocket is interiorly ribbed with rounded edge ribs, the device also includes a magnet disposed within the body for supporting the body against a surface, and the body defines a covered recess within the boss for receiving the magnet.

THE DRAWING

Figure 2:
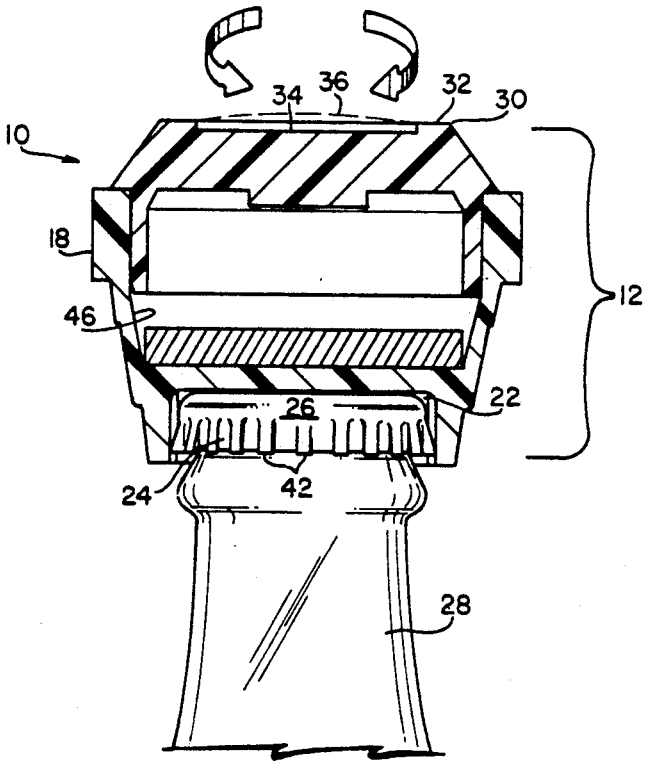

The invention will be further described as to an illustrative embodiment in conjunction with the attached drawings, in which:

FIG. 1 is an axonometric view of the device exploded to show component parts; and, FIG. 2 is a view in vertical section taken on line 2—2 in FIG. 1.

PREFERRED MODES

With reference now to the drawings in detail, in FIGS. 1 and 2 the device is shown generally at 10 and comprises a body 12 with an upper conical portion 14, a lower conical portion 16 and a protruding circular midrib 18 therebetween. The upper conical portion 14 and the lower conical portion 16 are oppositely tapered as shown.

The lower conical portion 16 is truncated at 20 and defines an outwardly open cylindrical pocket 22. The pocket 22 is adapted to nonslippingly grip the ridges 24 of a crimped-on bottle cap 26 of bottle 28. With the device 10 positioned as shown in FIG. 2 rotation of the device relative to the bottle 28 rotates the cap 26 relative to the bottle facilitating its removal or with suitable pressure upon the device returning the cap to the bottle.

The upper conical portion 14 is also truncated, at 30, to define a transverse boss 32, which may be shallowly recessed at 34 for receiving an identifying disc 36, advertising button, team logo, or like informational or decorative device. The function of the boss 32 is to provide a location for application of pressure against the device 10 by the user's hand, specifically by the portion of the hand between the thumb and forefinger. By affording this place of force application, the present invention enables a user gripping the device 10 to simultaneously push against the cap 26 and comfortably turn the device with its captured cap, a combination of efforts not available in prior art devices of like character, where a choice had to be made between downward force application and rotation with the cap engaged.

The device 10 is conveniently molded of rigid plastic by conventional means. A preferred form of the device has separately molded upper and lower conical portions 14, 16 with the midrib 18 being molded integrally with the lower conical portion 16, as shown. The midrib 18 is a circular protrusion which has a knurled surface 35, suitably by means of a series of spur teeth 36 formed on the midrib, but any means of increasing friction at the midrib may be used. Similarly, the interior of the pocket 22 is ribbed with vertically disposed ribs 38, suitably rounded to provide a radiused outer edge 40, spaced to accommodate between them the radial projections 42 of the cap 26, and sized to engage the projections laterally as the device 10, seated as in FIG. 2, is rotated on its vertical axis. The cap 26 is not damaged by the rotation and thus may be reapplied and resealed, with the same device 10.

The separate upper and lower portions 14, 16 are joined by solvent welding, spin welding or like means.

A magnet 44 is provided within the device, in certain embodiments, to facilitate storage against a vertical surface such as a refrigerator. The magnet 44 is shown in FIG. 2 as enclosed within a recess 46 formed within the conical lower portion 16.

In a typical device 10, the device is approximately 1.5–1.75 inches in height, and the midrib 18 is located approximately ⅔ of the way up the body vertical axis and has a diameter not less than about 150% of the approximately greater than one inch diameter of the pocket 22, providing a decided mechanical advantage of twisting a greater diameter to rotate a lesser diameter. The boss 32 is typically approximately one inch in diameter or greater or smaller as required for its use.

The foregoing objects are thus met, including a cap closure removal device which provides increased mechanical advantage, a structure complimentary to the hand, and which preserves cap contours for resealing convenience.

I claim:

1. Crimped cap removal and return assist device comprising a body having oppositely tapered upper and lower conical portions and a protruding circular midrib therebetween, said lower conical portion being truncated and defining an outwardly open cylindrical pocket adapted to non-slippingly grip the ridges of a crimped-on bottle cap for rotation on or off a bottle, said upper conical portion being truncated to define a transverse boss, said midrib being of greater diameter than said lower conical portion pocket and adapted to be gripped by a user's hand for rotating said body in the cap-engaged condition of said pocket, said upper conical portion boss being adapted and arranged to support the user's hand between the thumb and index finger thereof for application of increased hand pressure to said body while rotating the same for removal or return of said cap.

2. Crimped cap removal and return assist device according to claim 1 in which said midrib is peripherally knurled for enhanced grippability.

3. Crimped cap removal and return assist device according to claim 1, in which said body is formed of rigid plastic.

4. Crimped cap removal and return assist device according to claim 1, in which said pocket is interiorly ribbed for positive engagement with a bottle cap.

5. Crimped cap removal and return assist device according to claim 1, including also a magnet within said body for supporting said body against a surface.

6. Crimped cap removal and return assist device according to claim 1, in which said midrib has a diameter not less than about 150% of the diameter of said pocket.

7. Crimped cap removal and return assist device according to claim 6, in which said midrib is located approximately ⅔ of the way up the body vertical axis, whereby the upper conical portion is less vertically extended than said lower vertical portion.

8. Crimped cap removal and return assist device according to claim 7, in which said midrib is vertically extended a distance approximately equal to the vertical extension of said pocket.

9. Crimped cap removal and return assist device according to claim 8, in which said body is molding of a rigid plastic.

10. Crimped cap removal and return assist device according to claim 9, in which said midrib is peripherally knurled with spur teeth and said pocket is interiorly ribbed with rounded ribs.

11. Crimped cap removal and return assist device according to claim 10, including also a magnet disposed within said body for supporting said body against a surface.

12. Crimped cap removal and return assist device according to claim 11, in which said body defines a covered recess within said boss for receiving said magnet.

* * * * *